United States Patent [19]

Datz et al.

[11] 4,224,981

[45] Sep. 30, 1980

[54] FEED-WATER HEATER FOR STEAM POWER PLANTS

[75] Inventors: Rudolf Datz, Baden; Helena Riegger-Dreher, Zurich, both of Switzerland

[73] Assignee: BBC Brown Boveri & Company Limited, Baden, Switzerland

[21] Appl. No.: 918,510

[22] Filed: Jun. 23, 1978

[30] Foreign Application Priority Data

May 12, 1978 [DE] Fed. Rep. of Germany ..... 2820736

[51] Int. Cl.[3] ..... F28B 9/10; F28D 1/06; F28D 7/06; F28F 9/22

[52] U.S. Cl. ..... 165/114; 122/441; 165/160; 165/DIG. 24

[58] Field of Search ..... 165/114, 160, DIG. 24; 122/32, 441

[56] References Cited

U.S. PATENT DOCUMENTS

| | | | |
|---|---|---|---|
| 1,764,716 | 6/1930 | Ehrhart | 165/114 |
| 2,180,840 | 11/1939 | Tuley et al. | 165/114 |
| 3,349,841 | 10/1967 | Stoker | 165/114 |
| 3,795,273 | 3/1974 | Brigida et al. | 122/441 |
| 3,938,588 | 2/1976 | Coit et al. | 122/441 |

*Primary Examiner*—Sheldon Richter

*Attorney, Agent, or Firm*—Burns, Doane, Swecker & Mathis

[57] ABSTRACT

A feed-water preheater for a steam power plant is disclosed. Feed-water at a relatively low temperature is conducted through bundles of heater tubes in heat exchange relation with steam from the turbine. The heater tubes are arranged in a U-shaped bundle, with one leg of the U serving as the cold inlet side and the other leg of the U serving as the warm outlet side of the heat exchanger. A partition extends lengthwise of the heater tubes between the legs and the U-shaped bundle. The steam inlet is located at the warm outlet side of the tubes and the housing forms a steam chest around the tubes. Deaerating pipes are provided on each side of the partition in the center of the bundle of heater tubes with openings spaced along the length of the deaerating pipes for receiving the noncondensable gases from the steam, and to draw off the gases through the deaerating pipes.

9 Claims, 2 Drawing Figures

FEED-WATER HEATER FOR STEAM POWER PLANTS

BACKGROUND OF THE INVENTION

This invention relates to feed-water heaters for steam power plants.

In steam power plants, a supply of steam at high pressure and high temperature flows through a steam turbine to drive the turbine as the steam expands. At an intermediate stage in the turbine, steam is bled from the turbine and conducted in- one or more feed-water heaters to heat the water that is finally supplied to the boiler, thereby increasing the efficiency of the system. A conventional feed-water heater includes a housing surrounding a heat exchanger. The feed-water for the boiler flows through a number of heat exchangers, and steam bled from the turbine flows into the housing to heat the water flowing through the heat exchangers.

If the feed-water heater housing is under vacuum during operation, a certain amount of atmospheric air will enter the pipeline system and as a result will enter the heater. In order to avoid having the noncondensable gases interfere with the transfer of heat between the heat exchanger surface and the steam, the noncondensable gases must be removed from the heater. The noncondensable gases remain stagnant around the heat exchanger surface, and reduce the thermodynamic efficiency of the feed-water heater. The accumulation of large quantities of noncondensable gases can also lead to severe corrosion of the heat exchanger tubing, especially if the chemical composition favors corrosion, such as ammonia contained in air.

Various proposals have been made for removing the noncondensable gases. It has been proposed, for example, to install baffles in the feed-water heaters to provide the proper flow of ths steam that is to be condensed. At the end of the condensation path, the noncondensable gases are then removed by suction devices. An example of such a system is disclosed in Mitteilungen der VGB, Number 102, June 1966, pages 184 to 190. These prior proposals have the main disadvantage that relatively high steam pressure losses, i.e. thermodynamic losses, will occur. This is especially true in the case of high output units because the distance between the individual baffles must be relatively close.

It is an object of this invention to design a feed-water heater which avoids the disadvantages of the prior and which will make it possible to remove the noncondensable gases efficiently from the feed-water heater.

SUMMARY OF THE INVENTION

In accordance with this invention, the heat exchanger tubes through which the feed-water flows are arranged in a U-shape, with a central partition which blocks the flow of steam through the bundle directly from the steam inlet to the low temperature water inlet side. The steam flows around the heat exchanger tubes to reach the low temperature water inlet side. In the center of the bundle of heat exchanger tubes, on both sides of the partition, a plurality of deaerating pipes are positioned. The deaerating pipes are provided with openings spaced lengthwise of the heat exchanger tubes. This arrangement minimizes the accumulation of noncondensable gas in the interior of the heat exchanger tubes, and yet does not result in high steam pressure losses.

DESCRIPTION OF THE DRAWINGS

A preferred embodiment of the invention is illustrated in the accompanying drawings in which.

DETAILED DESCRIPTION OF THE PREFERRED EMBODIMENT

Figure 1:
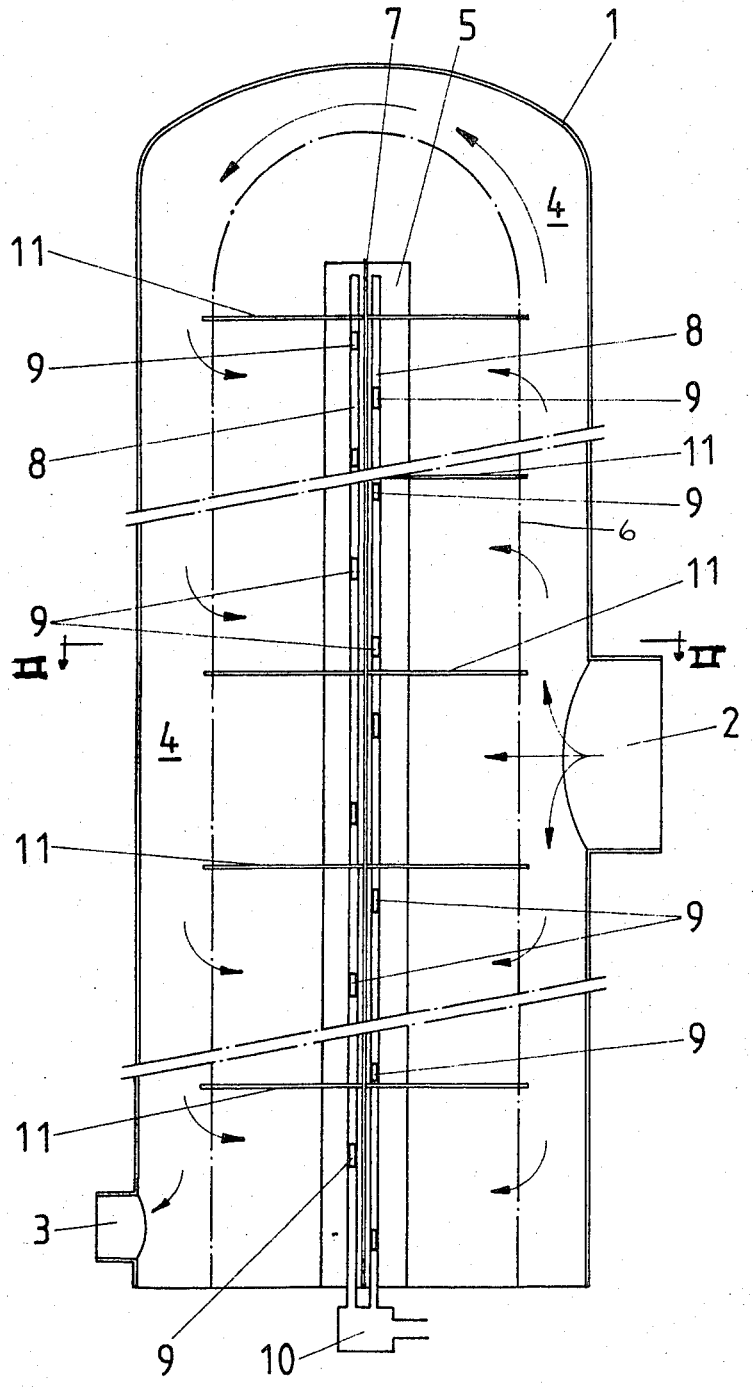
FIG. 1 is a longitudinal cross-sectional view of the feed-water heater.

In the drawings, like reference numerals have been used for like parts. The feed-water heater of this invention includes a housing 1 which is provided with a steam inlet 2 and a condensate outlet 3. The housing 1 forms a steam chest 4. A pair of support members 5 are mounted in the housing to support a bundle of heat exchanger tubes 6 through which the feed-water flows. The heat exchanger tubes 6 are bent in the shape of a U, and are shown schematically in FIG. 1. A partition 7 is mounted between the supports 5 in the interior of the heat exchanger tubes 6 to divide the tubes into a low temperature section at the left side of the partition, as viewed in FIG. 1, and a high temperature section at the right side of the partition, as viewed in FIG. 1. Deaerating pipes 8 are mounted in the interior of the heat exchanger tubes 6 on opposite sides of the partition 7. The deaerating pipes 8 are provided with openings 9 at spaced intervals along the length of the pipes. The deaerating pipes are closed at the upper end, as viewed in FIG. 1. At the lower end, the pipes are connected with a suction fitting 10 for receiving the gases that flow into the deaerating pipes. Baffles 11 are arranged horizontally around the tubes 6 and spaced apart axially of those tubes 6.

A conventional manifold e.g. a water box is provided at the lower end of the housing 1 for conducting feed-water into the low temperature section of the heat exchanger tubes 6 and out of the high temperature section, from which it flows into the next heater, and finally into the boiler.

Figure 2:
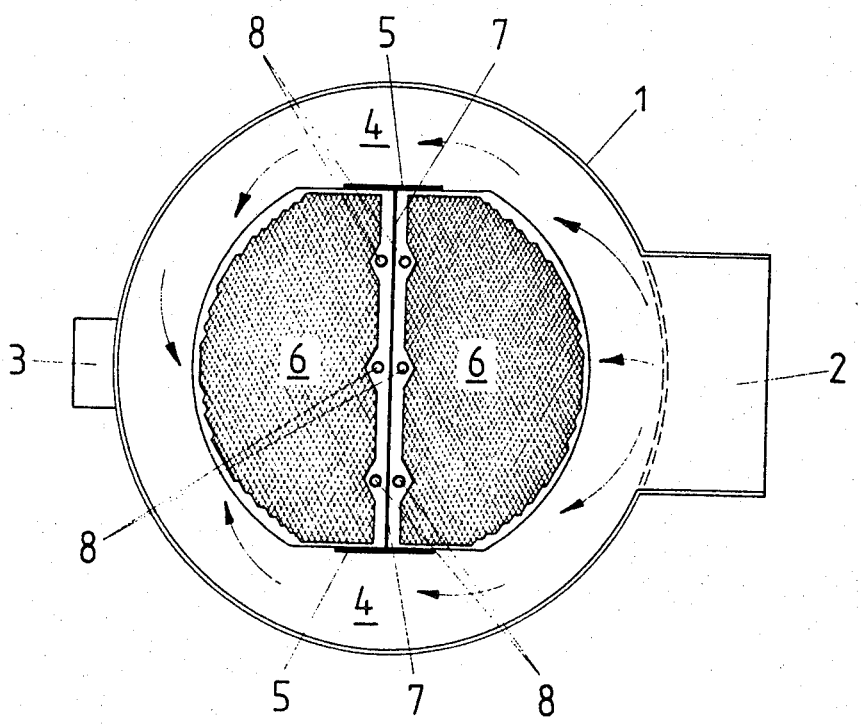
FIG. 2 of the feed-water heater along the line II—II in FIG. 1.

In operation, bleeder steam from the turbine flows through the steam inlet 2 into the heater. At the same time, low temperature feed-water is introduced to the low temperature section of the heat exchanger tubes 6. The steam flows around the heat exchanger tubes in the direction shown by the arrows in FIGS. 1 and 2, thereby heating the water contained in the tubes. As the steam condenses, the condensate is removed through the outlet 3. As the steam flows around the heat exchanger tubes, a low pressure region is formed in the center of the tubes on opposite sides of the partition 7. The noncondensable gases contained in the steam are drawn inwardly into this low pressure region and the gases pass into the deaerating pipes 8 through the openings 9. The gases are then drawn off from the deaerating pipes 8 through the suction fitting 10.

The feed-water heater, in accordance with this invention, has the advantage that due to the partition 7 between the low temperature section and the high temperature section of the heat exchanger tubes steam does not flow directly from the inlet 2 through the high temperature section and then into the low temperature section. Instead, the steam flows around the tubes of each section and enters the low temperature section from the steam chest 4. By placing the deaerating pipes 8 on both sides of the partition, the noncondensable gases are extracted from the heater at the end of the steam condensation path. Furthermore, the point of lowest pressure within each half of the heat exchanger is located near the partition, as are the deaerating pipes also. Since the steam is flowing at a minimum velocity across the entire surface of the heat exchanger tubes, the steam pressure loss within the nest of tubes will be held to a minimum and a proper extraction of noncondensable gases is achieved.

While this invention has been illustrated and described in accordance with a preferred embodiment, it is recognized that variations and changes may be made therein without departing from the invention, as set forth in the claims.

What is claimed is:

1. A feed-water heater for steam power plants comprising a housing having a steam inlet and a condensate outlet, a plurality of heat exchanger tubes in said housing between said inlet and said outlet, said heat exchanger tubes being arranged in the shape of a U having a low temperature section and a high temperature section and the two legs of the U having a width, partition means in said housing extending substantially the entire width of the legs of the U between said low temperature section and said high temperature section for preventing the direct flow of steam from one section to the other, and deaerating means on opposite sides of said partition means for withdrawing gas from the regions adjacent each of said opposite sides of said partition means.

2. A feed-water heater according to claim 1 wherein said heat exchanger tubes are arranged in the shape of a U, and said low temperature section and said high temperature section are provided by the respective legs of said U.

3. A feed-water heater according to claim 2 wherein said partition means includes a partition extending substantially the entire length of said heat exchanger tubes.

4. A feed-water heater according to claim 3 wherein said deaerating means includes deaerating pipes positioned on opposite sides of said partition, said deaerating pipes having a plurality of openings spaced along the length of said pipes at a uniform distance from each other.

5. A feed-water heater according to claim 4 wherein said deaerating pipes are closed at one end and said deaerating means includes a suction fitting for receiving gases from said deaerating pipes.

6. A feed-water heater according to claim 1 including a plurality of baffles spaced longitudinally of said tubes and arranged for preventing the flow of gases lengthwise of said tubes.

7. A feed-water heater according to claim 1 wherein said housing is spaced from said heat exchanger tubes throughout substantially the entire length of said tubes, thereby forming a steam chest in said housing around said tubes.

8. A feed-water heater for steam power plants comprising a housing having a steam inlet and a condensate outlet, a plurality of heat exchanger tubes in said housing between said inlet and said outlet, said tubes being arranged in the shape of a U with the two legs of the U having a length and a width and having a low temperature section and a high temperature section, partition means in said housing between said low temperature section and said high temperature section, extending over substantially the entire length of the legs of the U and substantially the entire width of the legs of the U of said plurality of tubes, for preventing the direct flow of steam from one section to the other, and deaerating means adjacent to both sides of said partition for withdrawing gas from the region adjacent to said partition, both the steam inlet and the condensate outlet being arranged on opposite sides of the partition means so that the direction of steam flow is from the outside of the plurality of tubes to the center of the heater in both the high temperature section and the low temperature section.

9. A feed water heater as in claims 1 or 8 wherein the heat exchanger tubes and the housing are arranged vertically.

* * * * *